United States Patent [19]

Le Magourou

[11] Patent Number: 4,525,610

[45] Date of Patent: Jun. 25, 1985

[54] QUICK MAKE AND BREAK PLUG AND SOCKET CONNECTOR

[75] Inventor: Yves Le Magourou, Ermont, France

[73] Assignee: Societe d'Exploitation des Procedes Marechal, Paris, France

[21] Appl. No.: 542,394

[22] Filed: Oct. 17, 1983

[30] Foreign Application Priority Data

Oct. 21, 1982 [EP] European Pat. Off. ..... 82 401934.3

[51] Int. Cl.[3] ..... H01R 33/28

[52] U.S. Cl. ..... 200/51.13; 200/51.09; 339/41

[58] Field of Search ..... 200/51.13, 51.09, 51.08; 339/41, 42, 43, 89 R, 89 M, 90 R

[56] References Cited

U.S. PATENT DOCUMENTS

| | | | |
|---|---|---|---|
| 2,857,486 | 10/1958 | Hubbell et al. | 200/51.09 |
| 3,041,420 | 6/1962 | Berry et al. | 200/50 B |
| 3,510,613 | 5/1970 | Barden et al. | 200/67 C |
| 3,853,376 | 12/1974 | Marechal | 339/41 |
| 3,982,804 | 9/1976 | Marechal | 339/41 |
| 4,154,991 | 5/1979 | Hickman et al. | 200/17 R |

FOREIGN PATENT DOCUMENTS

| | | | |
|---|---|---|---|
| 337290 | 5/1921 | Fed. Rep. of Germany . | |
| 462664 | 7/1928 | Fed. Rep. of Germany . | |
| 619631 | 9/1935 | Fed. Rep. of Germany | 339/90 R |
| 1102237 | 3/1961 | Fed. Rep. of Germany . | |
| 1242735 | 6/1967 | Fed. Rep. of Germany . | |

*Primary Examiner*—Stephen Marcus
*Assistant Examiner*—Renee S. Kidorf
*Attorney, Agent, or Firm*—Sandler & Greenblum

[57] ABSTRACT

A plug and socket connector comprises resilient contacts which are adapted to be engaged in bayonet fashion. Electrical contact between each input terminal and a corresponding socket connector-pin is established by coupling two contact studs, one contact stud being carried by a conductive arm rigidly attached to a connector pin, the other being attached to an electrical supply lead. When a plug and socket are disengaged, the contact studs being coupled are positioned in different relative angular positions with respect to the axis of the plug socket. The contact studs are placed into a position of angular coincidence by rotating the plug with respect to the socket. At the end of the rotation of the plug, each arm is subjected to an abrupt pivoting movement in which it is displaced toward an oppositely acting contact stud as a result of a release of the energy stored during the rotation.

18 Claims, 8 Drawing Figures

QUICK MAKE AND BREAK PLUG AND SOCKET CONNECTOR

BACKGROUND OF THE INVENTION

1. Field of the Invention

The present invention generally relates to a plug and socket connector comprising a socket connected to a power supply line and a corresponding plug which supplies electricity utilization equipment, the connector conforming to safety standards which specify that socket contacts must be disconnected from a voltage source when a plug is withdrawn from the socket.

More specifically, the present invention is particularly applicable to the construction of plug and socket connectors designed for safe use in inflammable or explosive mediums.

2. Discussion of Prior Art

In order to ensure that socket contacts remain dead when a plug and socket are separated, one normal practice in conventional devices uses a switch associated with a plug socket and disposed between the power supply line and the socket. For closing the circuit, at least, the switch is actuated by rotating the socket after insertion of plug. The disadvantage of this equipment lies in the fact that it requires a flexible connection between each contact of the socket and a corresponding input terminal. Thus, there exists the potential danger of damaging the end of each flexible connection as a result of successive operation of the device. Further, while it is possible in such a case to provide a quick break by making use, e.g., of resilient means released by an independent mechanism, the switch-closing operation remains conventional and is therefore not entirely satisfactory for use in an inflammable or explosive environment.

These drawbacks can be overcome by resorting to the use of a plug and socket connector in which provision is made for resilient pressure contact.

SUMMARY OF THE INVENTION

Accordingly, it is a general object of the present invention to provide a new and improved plug and socket connector which can disconnect socket contacts from a voltage source when the plug is withdrawn therefrom.

It is a further object of the present invention to provide a new and improved plug and socket connector in which the socket and corresponding input terminal are easily connected and disconnected by simple axial and rotational movement of the plug.

To this end, the present invention relates to a plug and socket connector comprising, on one hand, a plug having a body in which an insulating support is rigidly mounted for carrying the plug-connector pins. These pins are designed to be connected, respectively, to the elementary conductors of a multiple-conductor electricity utilization (delivery) cable. On the other hand, the device comprises a socket having a body which includes the input terminals of a power supply line, and an insulating block which is rotatably mounted within the socket body and in which a plurality of bores are formed. Within each bore, a socket connector-pin is disposed which is slidably mounted under the action of resilient means; the resilient means urge the connector-pins outwardly to a position of abutment in which each socket connector pin resiliently cooperates with a corresponding plug connector-pin when the plug and socket are interengaged. The plug and socket bodies are adapted to carry interdependent means for guiding and locking the plug and socket while their bodies undergo an axial displacement and an associated rotational displacement with respect to each other. These displacements are performed either successively or simultaneously. The plug connector-pins are accompanied in their movements by the insulating block during rotation. Each sliding socket connector-pin can comprise either a solid pin adapted to cooperate with a plug connector-pin associated therewith in end-to-end contact, or can comprise a pin provided at its end with a recess designed to fit over a corresponding end of the plug connector-pin.

The connector, in accordance with the present invention, is distinguished by the fact that the electrical connection between each input terminal and the corresponding socket connector-pin is established by coupling adjacent contact studs, one of the studs being attached to the input terminal and the other stud being carried by the end of a conducting arm which is rigidly attached to a socket connector-pin and which is capable of pivoting about the lower end of the tubular socket. When the plug and socket are not interengaged, the contact studs to be connected are disposed in different relative angular positions with respect to the axis of the plug socket so that rotation of the plug with respect to the socket is an interengagement movement which brings the studs into abutment and into a position of angular coincidence. The conducting arm is first maintained in a stationary position with respect to the insulating block by appropriate means, which means also serve to release the conducting arm substantially at the end of the relative movement of rotation of the plug with respect to the socket. The conducting arm is then permitted to be pivotably displaced about a corresponding tubular sheath within a bore in the insulating block in order to rapidly couple the two contact studs. The studs are coupled under the force of the partial release of energy which was stored by the resilient means; the energy is released at the time of the relative rotational movement of the plug to the socket. On the other hand, during the opposite, i.e., counterclockwise, rotation of the plug with respect to the socket, which permits separation of the plug from the socket, the contact stud carried by the conducting arm moves away from the other contact stud, and the remaining energy stored by the resilient means ensures rapid opening of the connector. Finally, a stop causes the conducting arm, at the completion of the reverse, i.e., counterclockwise, rotational movement of the plug and socket, to return to its initial position in which the stop is maintained stationary with respect to the insulating block.

In a first aspect of the present invention, a quick make and break electrical connector is provided which comprises a plug including an insulating body portion and a plurality of plug connector-pins. The body portion comprises means for positioning the plug connector-pins within the plug and is rigidly mounted within the plug. A socket having a body portion includes means for receiving at least one input terminal of an electrical power supply line. It also includes an insulating block which is rotatably mounted within the body portion. The insulating block has a plurality of bores therein, and a socket connector-pin is slidably positioned within each of the bores. Resilient means for biasing each of the socket connector-pins into engagement with a respective plug connector-pin is provided to ensure that when the plug and socket are rotatably interengaged, the plug connector-pins will rotate together with the insulating block. The connector further includes means for guiding the plug during rotation and axial movement of said plug within the socket, and means for blocking the plug in a fixed position with respect to the socket. A first contact stud is attached to each of the input terminals, and a respective second contact stud is attached to the end of a conducting arm which is rigidly attached to each of the socket connector-pins. Each of the conducting arms is pivotable about a lower end of each of the insulating block bores, and an electrical connection is thus formed between each input terminal and a corresponding socket connector-pin. This electrical connection is established by coupling respective first and second contact studs, the first and second contact studs occupying different relative angular positions with respect to a central axis of the socket when the plug and socket are not interengaged. The apparatus further comprises means for rotating the studs into a position of angular coincidence.

The present invention is provided for in a second aspect thereof by a quick make and break electrical connector which comprises a plug including an insulating disc and a plurality of plug connector-pins which are positioned within the disc. The plug is attached to at least one electrical cable. A socket for receiving the plug includes a body portion, a casing, and an insulating block which is rotatably positioned within the body portion. The insulating block has a plurality of bores therein, individual socket connector-pins being slidably and resiliently positioned within respective bores. Each socket connector-pin has a conductive arm attached to one end thereof, a first electrical contact stud being attached to a respective electrical supply lead, a second electrical contact stud being associated with each of the first contact studs and being attached to one of the arms. The socket further comprises means for abruptly biasing respective second contact studs into abutment with respective first contact studs upon axial insertion and rotation of the plug with respect to the socket. The plug and socket are capable of occupying the first and second positions. The first position is and open circuit position in which the plug is not inserted within the socket, and in which first and second contact studs are not in engagement, the first contact studs being located at an angular position which is different from the angular position occupied by the second contact studs. This serves to disconnect the sockets from the electrical supply. The connector occupies a second, distinct position, in which the plug is rotated with respect to the socket so that the respective first and second contact studs are abruptly biased into the same angular position with respect to the socket by a spring which engages each arm.

BRIEF DESCRIPTION OF THE DRAWINGS

Other features, objects, and advantages of the present invention will become more fully apparent to those of ordinary skill in the art to which the present invention pertains from further consideration of the following description and accompanying drawings, wherein.

DETAILED DESCRIPTION OF THE INVENTION

Figure 1:
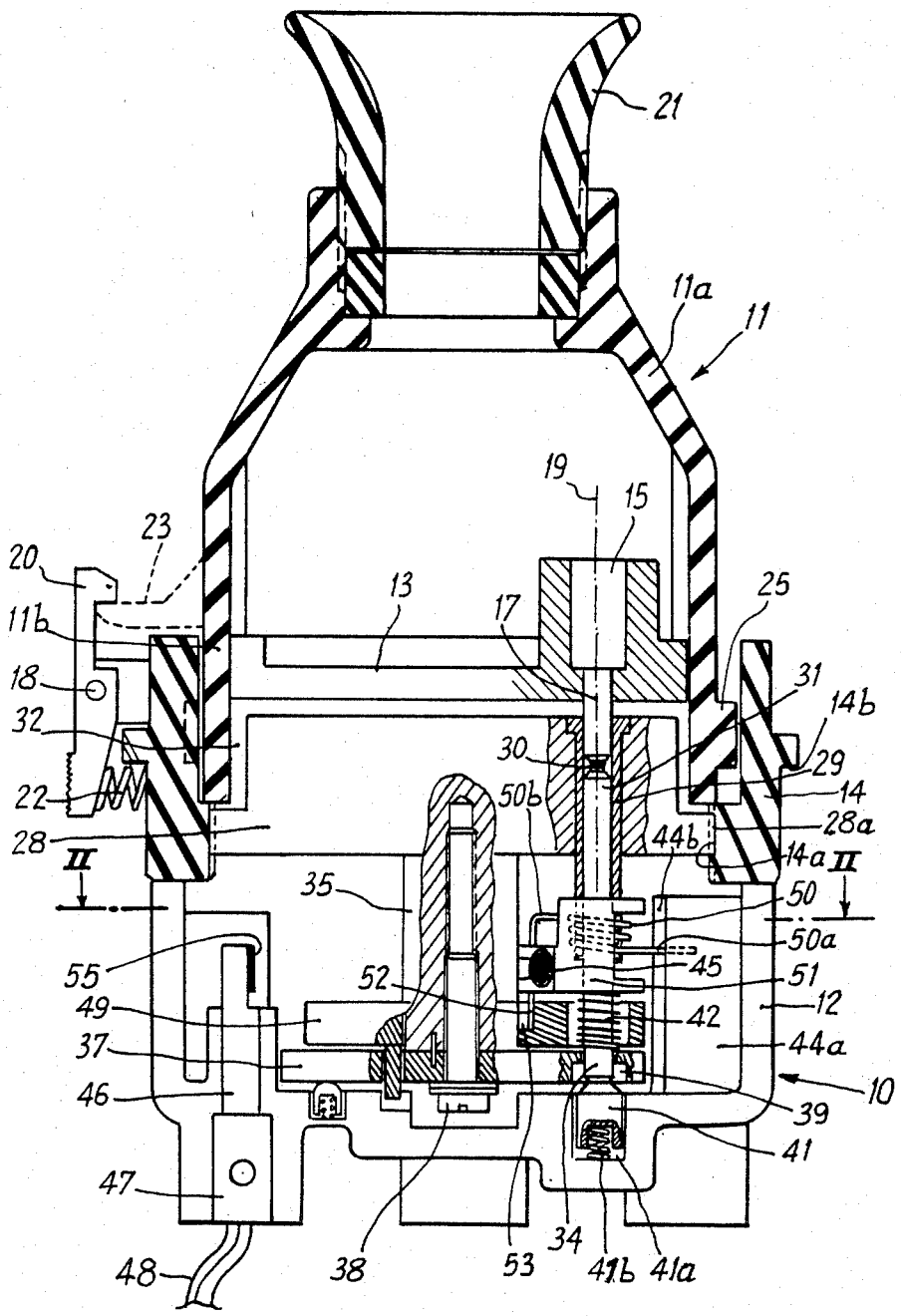
FIG. 1 is a simplified cross-sectional axial view of a plug and socket connector formed in accordance with the present invention, the cross-section being an axial one taken along the chain-dotted line I—I of FIG. 2.
Figure 2:
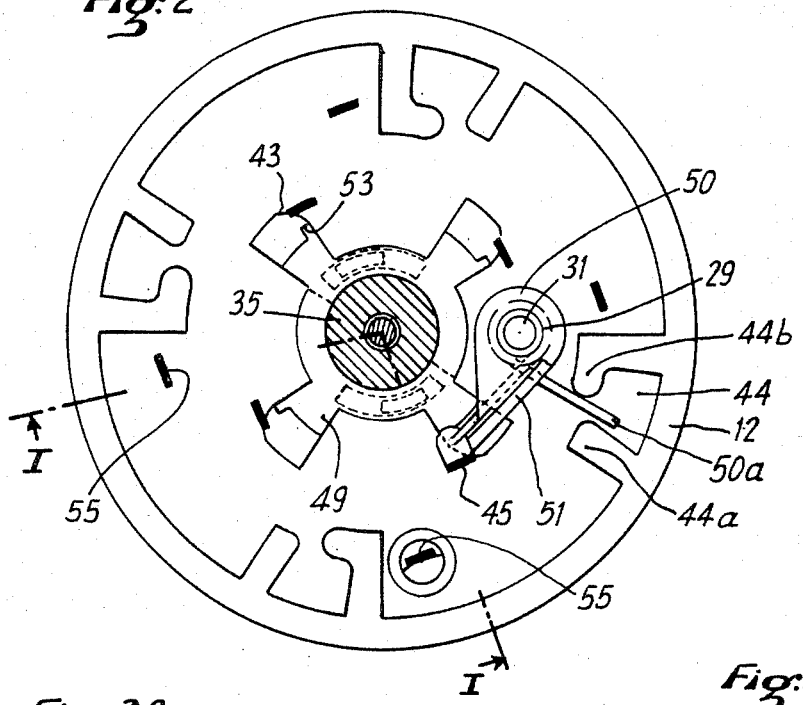
FIG. 2 is a cross-sectional view of the connector of FIG. 1 taken along line II—II of FIG. 1.

In the accompanying drawings of FIGS. 1–3*f*, a conventionally designed plug 11 is provided for use with an industrial plug and socket connector. Plug body 11*a* is adapted to carry an insulating disc 13 in which plug connector-pins, e.g., pin 17, are mounted in rigidly fixed relationship. For purposes of simplifying the drawing, the plug connector-pins other than pin 17, which is shown, have been omitted from the figures. Outwardly extending lead wires 19 are connected to screw terminal 15, the terminals being rigidly affixed to respective connector-pins. The multiple-conductor cable (not shown in the drawings) includes elementary conductors which terminate, respectively, at each plug connector-pin. The cable passes through cable gland 21, i.e., a stress-relief means, which is well known. Plug body 11*a* is provided with a locking lug 23 along its exterior surface, a bayonet lug 25 along its exterior surface, and, if necessary, with an annular flange fitted with an O-ring seal (not shown); the components of the plug are intended to cooperate with corresponding elements of the plug socket as part of an explosion-proof or flame-proof connector.

Supply leads, e.g., supply lead 48, terminate at the bottom of plug socket 10. The socket comprises a casing 12 of insulating material. Again, for purposes of facilitating review of the drawings, only one lead 48 has been shown in FIG. 1; a plurality of such leads are, of course, provided. The plug-socket casing is rigidly attached to an upper annular body portion 14, having an annular bearing shoulder 14*b* for mounting a socket in accordance with the safety standards required for flame-proof and/or explosion-proof equipment; the socket is accordingly attached to a supporting wall by conventional means, which again are not shown in the drawings.

In accordance with conventionally used arrangements, annular body 14 is adapted to carry a hinge-pin 18, a hook 20 being pivotably mounted on the hinge-pin and urged by spring 22 towards the axis of the plug and socket electrical connector.

Annular body 14 includes an axial opening having a substantial width, the opening including an internal screw-thread 14*a* and being adapted to cooperate with a corresponding external screw-thread 28*a* of insulating block 28. The insulating block can be engaged within annular body portion 14. In the operational position of the connector assembly, it is possible to rotatably displace the insulating block in co-axial relation with respect to the annular body, e.g., with respect to plug socket 10, insofar as the annular body forms an integral part of the socket.

Bores, e.g., bore 30, are provided within block 28 and for receiving tubular sheaths 29, which are set within the bores. Socket connector-pins 31 are housed within the sheaths in the bores and are designed to cooperate by end-to-end contact with plug connector-pins 17. Only one connector-pin and only one socket connector-pin have been illustrated to enhance review of the drawings, but it is possible, within the embodiment contemplated by the present invention, to have any number of contacts, e.g., four contacts, not including the ground, which has been omitted from the figures.

An annular groove 32, designed to receive tubular end 11*b* of plug body 11*a*, is positioned between the upper portion of insulating block 28 and annular body 14. Further, the internal face of annular body 14 has a bayonet-coupling ramp which is intended to cooperate with lug 25, which is carried by the plug. The ramp includes an access passageway 33, axially located with respect to the socket, and is also provided with a locking passageway 33' located in a transverse plane with respect to the axis of the socket.

Insulating block 28 includes a cylindrical axial extension 35 and a removable disc 37, whose removal permits assembly and disassembly of the device, when it must be fixed; the disc is located along the underside of the cylindrical extension. Screw 38 can be removed to separate disc 37 from the remainder of the assembly. This is best illustrated in FIG. 1.

Socket connector-pins 31 are each slidably mounted within a respective tubular sheath 29, and in opposition to the tension of a respective spring 42; the springs work in compression between the lower end of the connector-pins and disc 37 and serve to bias the pins 31 upwardly. Further, each connector-pin is capable of rotating within its tubular sheath and is adapted to carry at its lower end arm 51 which is attached to the connector-pin and located substantially transversely to the axis thereof. The arm is formed of an electrically conductive material and has one end portion which is adapted to carry a contact stud 45. The conducting arm is mounted in order to be capable of pivotable displacement about the lower end of tubular sheath 29. Line contacts, e.g., contacts 55, are placed, respectively, at the level of the end portions of conducting arms 51 and are connected to line wires, e.g., line wire 48, by conductive strips 46 and input terminals 47.

A substantially star-shaped retaining member 49, molded from insulating material, is positioned about insulating block extension 35 in a co-axial relation therewith.

Figure 3A:
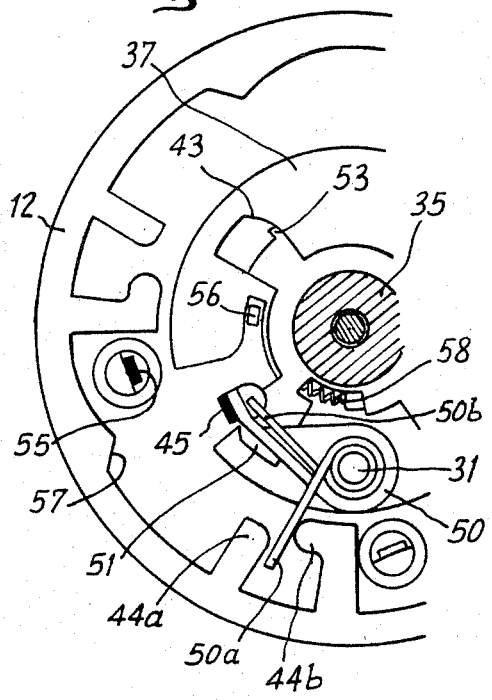
FIGS. 3*a*–3*f* are views similar to the view of FIG. 2, but having a different orientation and illustrating the various steps of operation of the connector when closed, as in FIGS. 3*a*, 3*b*, and 3*c*, and when the connector is opened, as in FIGS. 3*d*, 3*e*, and 3*f*.
Figure 3B:
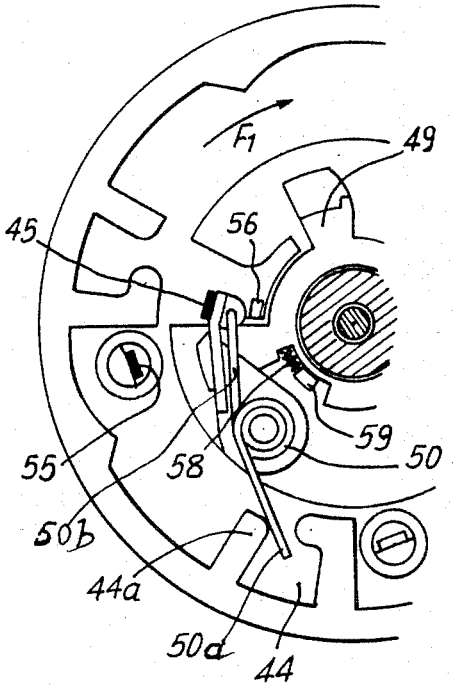

The retaining member 49 has arms which are equal in number to the number of socket connector-pins; the member is capable of rotating about extension 35. Spacer spring 58, as illustrated in FIGS. 3*a*–3*f*, is positioned between a bearing surface which forms part of disc 37, and a bearing surface which forms part of retaining member 49. The spacer spring 58 drives the bearing surface of retaining member 49 rotatably when insulating block 28 is rotatably displaced towards the closed-circuit position of the connector. Retaining member 49 can be rotatably displaced in the opposite direction by lug 59, as illustrated in FIG. 3*b*, which is carried by disc 37, and which can comprise means for forcing spring 58 to bear against the disc. The rotatable movement of member 49 towards the closed position of the connector is limited by stop 56, placed on the bottom wall of socket casing 12; it serves to limit rotation of member 49 before insulating block 28 has completed its travel. The difference in the amplitude of rotation of member 49 and of block 28 is created by the compression of spring 58.

Each conducting arm 51 is subjected to the action of a helical spring 50, which is engaged over the lower portion of a corresponding tubular sheath 29. A first one of the terminal arms 50*a* of spring 50 extends towards the periphery of casing 12 in order to engage and stay within groove 44. The groove is located parallel to the axis of the device and is limited by abutment ribs 44*a* and 44*b*, which project inwardly from the inner wall of the socket casing. The other, second terminal arm 50*b* extends first in a direction parallel to conducting arm 51 and is then bent downwardly, and at right angles, in order to extend parallel to the axis of the device and to engage corresponding perforations, or grooves, which are formed at the extremity of conducting arm 51. End portion 52 of terminal arm 50*b* passes entirely through the extremity in order to reach the level of retaining member 49.

At the end of each arm of the star-shaped retaining member 49, and on the face of the member which is directed towards the closed position of the connector, a substantially round guide ramp 43 is provided, which terminates in a notch 53 for receiving end portion 52 of spring 50.

Preferably, at least one locking-bolt 41, which is positioned within recess 41*a* in the bottom wall of casing 12, is subjected to the biasing action of spring 41*b*. The spring urges the locking bolt to move outwardly of the recess and to cooperate with counterbore 39 on the underside of disc 37. This will lock insulating block 28 in its rest position when plug 11 and socket 10 are separated from one another. In this position, each counterbore 39 is located directly beneath a corresponding bore 30, and a corresponding socket connector-pin 31 is provided with an extension 34. The extension engages counterbore 39 in a position in which its end lies flush with the underside of disc 37 at the completion of the axial engagement of the plug within the socket. This causes withdrawal of locking-bolt 41 from the counterbore. The arrangement ensures that insulating block 28 will lock when plug 11 is withdrawn and prevents rotation of the block towards the closed position of the connector, thus ensuring that the socket connector-pins are disconnected from a supply source.

The plug and socket can also be locked in the closed position of the connector; this locking action occurs automatically at the end of the rotation of plug 11 by engaging hook 20 within forked lug 23. Unlocking of the plug and the socket occurs by causing hook 20 to swing back in opposition to the action of spring 22. In the rest position of the device, when the plug and socket are separated from one another, hook 20 can be employed to attach a cover (not shown) which is pivotably mounted along the upper annular member 14 of plug socket 10 at a side of the plug socket remote from the hook.

Finally, at least one boss 57, forming an inwardly directed projection from the wall of casing 12 at the level of the ends of conducting arms 51, effectively prevents rotation of insulating block 28 towards the closed position of the connector when each conducting arm 51 has not returned to its engagement position. In other words, boss 57 prevents rotation of insulating block 28 when the rotational movement causing separation of the plug and socket has not been completed. The different stages of operation of the device are clearly illustrated in FIGS. 3A–3F. Plug 11 and socket 10 are initially separated; thereafter, the plug is engaged within the socket, and each plug connector-pin 17 is brought into a position opposite to bore 30 by one of the associated guiding elements for the plug and socket. Initially, the plug is axially displaced, i.e., inserted into the socket, to begin the bayonet engagement. Socket connector pins 31 are then thrust backwardly, i.e., downwardly, in opposition to springs 42; in particular, the connector-pin or pins which carry extensions 34 cause the withdrawal of corresponding locking-bolts 41. This, in turn, permits free rotational displacement of insulating block 28. In this position, as shown in FIG. 3A, end portion 52 of each spring 50 is engaged within a corresponding notch 53 of retaining member 49, and conducting arms 51 are thus locked into position.

Plug 11 is then subjected to the rotational displacement which comprises the second movement of the bayonet engagement. The rotational displacement is shown in the axial top view of FIG. 3B, and occurs in a clockwise direction, as indicated by arrow F1. The plug connector-pins displace insulating block 28 and disc 37. Terminal arms 50*a* of each spring 50 is held captive within groove 41 and are applied against abutment ribs 44*a*, each spring 50 thus expanding. Star-shaped retaining member 49 rotates along with insulating block 28 under the action of spring 58, until one arm of the retaining member comes into contact with stop 56; the stop is rigidly attached to casing 12 of plug socket 10. Insulating block 28 then continues its rotational movement over a short range of travel while compressing spring 58. Since block 28 displaces conducting arms 51 and springs 50, end portions 52 of the springs are withdrawn from notches 53, and conducting arms 51 are then subjected to an abrupt pivotal displacement towards the wall of casing 12; this abrupt displacement is caused by the action of the elastic energy stored by the springs during the rotational movement. Stop 56 is positioned such that contact stud 45 of each conducting arm is applied against an oppositely acting contact stud 55, which is in turn connected to line terminal 47.

Figure 3C:
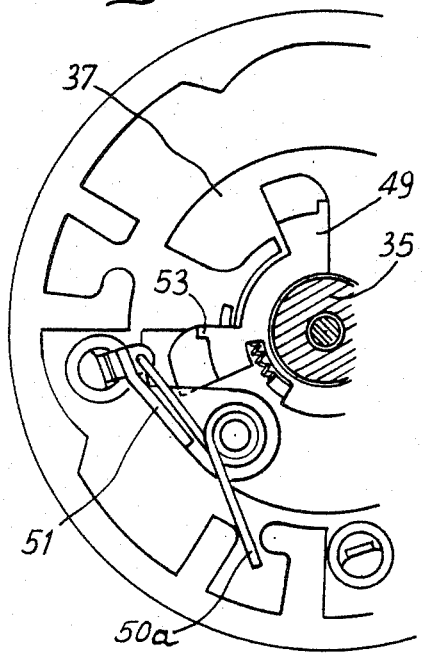

The device is then in its closed position, as shown in FIG. 3C, and as discussed hereinabove, is locked in such a position by cooperation of hook 20 and lug 23. Stop 56 is preferably arranged in order to ensure that arms 51 will undergo a slight pivotable displacement before contact studs 45 are located along the same axis as contact studs 55. The rotation thus continues over a relatively short interval, while oppositely acting contacts are already engaged. This produces a beneficial self-cleaning action on the contacts resulting from the friction of the abutting contacts. Similarly, the end contact studs of plug and connector socket pins 17 and 31, respectively, are self-cleaned by friction during the pivotal displacement of conducting arms 51, which are rigidly attached to connector-pins 31.

In the closed position of the connector, as shown in FIG. 3C, springs 50 are not in their fully expanded state, and the pivotal displacement of conducting arms 51 is stopped by contacts 55 before the springs have released the entire amount of stored energy.

Figure 3D:
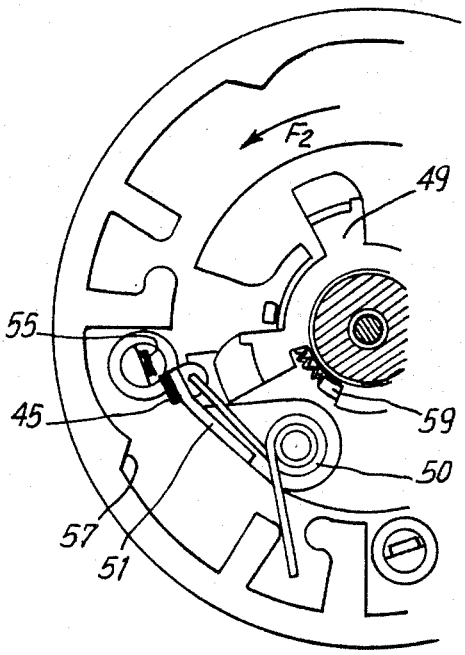
Figure 3E:
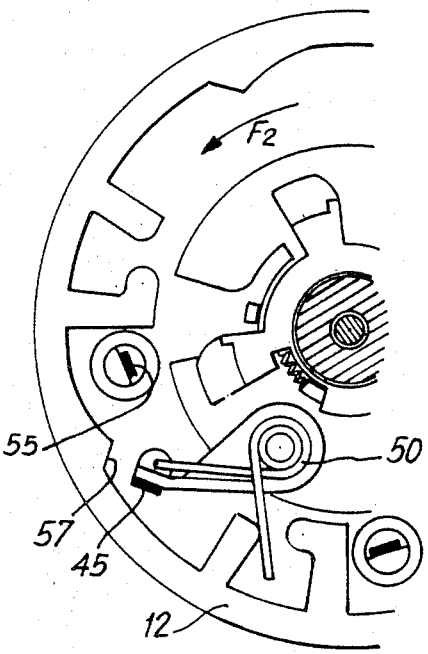

In order to open the connector, it is first necessary to unlock the connector-pin by releasing hook 20, whereby the plug will be displaced in counter-clockwise direction, as shown by arrows F2. Insulating block 28 is displaced by connector-pins 17, together with disc 37 and lug 59, which is rigidly fixed to disc 37. The lug, in turn, displaces retaining member 49. At the beginning of this movement, each contact stud 45 slides over opposing contact stud 55 until they separate, as illustrated in FIG. 3*d*, and undergoes an abrupt pivotal displacement towards the wall of casing 12 under the action of the remaining energy stored by spring 50, as shown in FIG. 3*e*. Thus, a quick disconnect, or break, of the electrical connection is achieved as a result of this motion. Springs 50 are then in a fully expanded state and no longer require the application of force on conducting arms 51. Return of the connector to its closed position is thus made impossible by boss 57, which prevents further displacement of the head of corresponding arm 51.

Figure 3F:
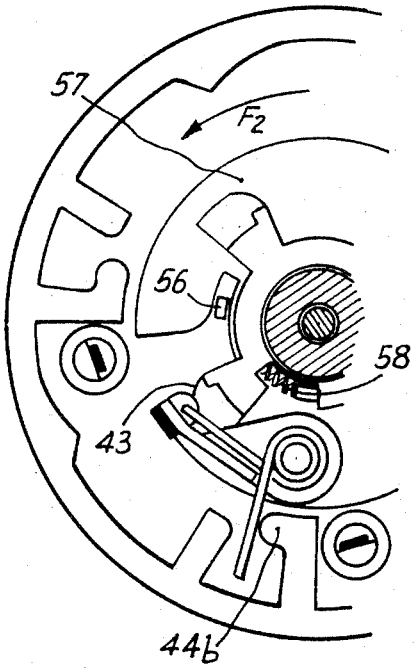

Towards the end of the rotation which brings connector plug lug 25 into a position opposite to the axial bayonet-locking passage (the rotational movement being limited by a stop which acts on disc 37, i.e., stop 56, which abuts retaining member 49 during the closing rotational movement), terminal arm 50*d* of each spring 50 bears on an abutment rib 44*b*, as shown in FIG. 3F, thus producing continuous pivotal displacement of a corresponding arm 51 towards the axis of the device. Spring end portion 52 then contacts guide ramp 43, slides on the ramp, and comes into position within notch 53 (see FIG. 3A). Conducting arms 51 are again locked in position, and the connector can again be closed.

Throughout the above description, it has been assumed that corresponding plug and socket connector-pins 17 and 31, respectively, cooperate in a resilient fashion, socket connector-pins 31 being subjected to the action of spring 42 and urged by the spring upwardly toward plug connector-pins 17. It is thus apparent that connector-pins 17 exert a thrust on connector-pins 31 at the time that plug 11 axially penetrates socket 10, in order to ensure resilient contact of the pins. Conducting arm 51, which together with its associated contact stud is rigidly affixed to connector-pin 31, follows this movement. The contact studs thus occupy different points along the axis of the connector (the axis assumed to be vertical) at the points in which the connector is in its rest position (in which the plug and socket are separated from each other) and when in the closed-circuit position of the connector. The difference in axial position may be relatively small but should advantageously be greater than the diameter of a contact stud. Thus, in the rest position of the connector, studs 45 and 55 to be coupled are located at both different relative angular positions and at entirely different axial levels. This enhances the safety of the device. In other words, any rotation of insulating block 28 without introducing plug 11 into socket 10, e.g., during failure of locking means 41 and 41*b*, is not likely to result in closing of the connector.

If it is preferred to dispense with the additional safety feature of requiring axial displacement to close the circuit within the socket, the device may be simplified by mounting connector-pin 31 within a respective tubular sheath 29 in non-slidable fashion, and by designing it in the form of a hollow pin. This constitutes a technical equivalent to the earlier-described embodiment and is certainly included within the scope of the invention, as are other details and modifications.

Similarly, a electrical connector in accordance with the invention can make use of all known arrangements used in other electrical connectors, e.g., angular displacement of at least one contact, insulating supports and blocks having variable angular positions, and single or double safety discs.

It will be readily understood from the above that many similar details and practical arrangements can be provided within the scope of the present invention and will become apparent to those of ordinary skill in the art with respect to all of the embodiments which have been described hereinabove in detail.

What is claimed is:

1. A quick make and break electrical connector comprising:

(a) a plug including an insulating body portion and a plurality of plug connector-pins, said body portion comprising means for positioning said plug connector-pins within said plug, said body portion being rigidly mounted within said plug;

(b) a socket having a body portion including means for receiving at least one input terminal of an electrical power supply line, and an insulating block rotatably mounted within said body portion, said insulating block having a plurality of bores therein, a socket connector-pin being slidably positioned within each of said bores, and resilient means for biasing each of said socket connector-pins into engagement with a respective plug connector-pin, wherein said plug and socket are adapted to be rotatably interengaged such that said plug connector-pins rotate together with said insulating block;

(c) means for guiding said plug during rotation of said plug within said socket and during axial movement of said plug within said socket, and means for locking said plug in a fixed position with respect to said socket; and (d) a first contact stud attached to each of said input terminals and a respective second contact stud being attached to the end of a conducting arm which is rigidly attached to each of said socket connector-pins, each of said conducting arms being pivotable about a lower end of each of said insulating block bores, wherein an electrical connection between each input terminal and a corresponding socket connector-pin is established by coupling respective first and second contact studs, said first and second contact studs occupying different relative angular positions with respect to a central axis of said socket when said plug and socket are not interengaged, said apparatus further comprising means for rotating said studs into a position of angular coincidence.

2. An electrical connector in accordance with claim 1 further comprising a plurality of elementary conductors forming a portion of a multiple conductor utilization cable, each of said conductors being attached to a respective plug connector-pin.

3. An electrical connector in accordance with claim 1 wherein each of said socket connector-pins is mounted within a tubular sheath which is positioned within a respective insulating block bore.

4. An electrical connector in accordance with claim 3 wherein said plug is adapted to be axially inserted into said socket and then rotated with respect thereto.

5. An electrical connector in accordance with claim 3 wherein said plug is adapted to be axially inserted and rotated within said socket simultaneously.

6. An electrical connector in accordance with claim 1 further comprising means for maintaining said conducting arm in a stationary position with respect to said insulating block and for releasing said conducting arm at the end of the relative movement of rotation of said plug with respect to said socket, said maintaining and releasing means permitting said conducting arm to pivot about a respective insulating block bore to abruptly bring said first and second contact studs into abutment under the biasing action of a resilient member.

7. An electrical connector in accordance with claim 6 further comprising means for separating said first and second contact studs under the action of said resilient member when said plug is rotated in a counterclockwise direction, said connector further comprising a stop adapted to limit movement of a rotatable retaining member and to move said conducting arm into its initial, stationary position with respect to said insulating block once said counterclockwise movement of said plug is complete.

8. An electrical connector in accordance with claim 7, said resilient member comprising a helical spring surrounding a base of said tubular sheath, one end of said helical spring extending towards the periphery of said socket body and being permanently engaged within a groove located parallel to the axis of said connector, said groove being formed by two abutment ribs which project inwardly from an interior wall of said socket body, the other end of said helical spring extending in a first direction parallel to said conducting arm and in a second direction at right angles to said first direction and parallel to the axis of said connector, said second end engaging a recess at the end of said conducting arm.

9. An electrical connector in accordance with claim 8 wherein said maintaining means include said second end of said of said helical spring and a notch formed in said freely rotatable retaining member, said retaining member being positioned co-axially with said insulating block, said retaining member rotating in response to rotation of said insulating block via a spacer spring positioned between a bearing surface on said insulating block and a bearing surface on said retaining member.

10. An electrical connector in accordance with claim 9 further comprising a stop rigidly attached to said socket body, said stop comprising means for stopping rotation of said retaining member at a time near the end of the rotational movement of said insulating block, permitting said insulating block to continue its movement, said stop further comprising means for compressing said spacer spring and for releasing said second spring end from said notch.

11. An electrical connector in accordance with claim 10 wherein said stop comprises a rib for defining the groove and wherein a slide ramp is formed on said retaining member and comprises means for guiding said second spring end to said notch.

12. An electrical connector in accordance with claim 10 further comprising a boss projecting inwardly from a wall of said socket adjacent the level of a conducting arm end portion, said boss comprising means for preventing rotation of said insulating block towards the closed position of said connector when said conducting arm is not in its initial, stationary position.

13. An electrical connector in accordance with claim 12 further comprising a locking bolt positioned within a recess and a bottom wall of said socket body when said plug and socket are separated, said locking bolt being urged upwardly by a spring into a counterbore of a plate which is attached to an underside of said insulating block, said counterbore being positioned directly below one of said insulating block bores, a corresponding socket connector-pin being provided with an extension, said extension comprising means for withdrawing said locking-bolt from said counter bolt when said socket connector-pin is abutted by a corresponding plug connector-pin.

14. An electrical connector in accordance with claim 1 wherein said locking means comprise means for securing said plug and socket against rotational displacement with respect to each other, said securing means being locked when said connector circuit is closed.

15. An electrical connector in accordance with claim 14 wherein said means for abutting said first and second contact studs further comprises means for cleaning said contact studs by rubbing them against one another.

16. An electrical connector in accordance with claim 1 further comprising threaded portions on the exterior surface of said rotating block and on the interior surface of said socket body, said threads forming a bearing for rotatably displacing said block within said socket.

17. An electrical connector in accordance with claim 1 wherein said first and second contact studs are separated by an axial distance when said plug and socket are disengaged which is greater than the diameter of each of said contact studs.

18. A quick make and break electrical connector comprising:

(a) a plug including an insulating disc and a plurality of plug connector-pins positioned within said disc, said plug being attached to at least one electrical cable; and (b) a socket having a body portion, a casing, and an insulating block rotatably positioned within said body portion, said insulating block having a plurality of bores therein, individual socket connector-pins being slidably and resiliently positioned within respective ones of said bores, each of said socket connector-pins having a conductive arm attached to one end thereof, a first electrical contact stud being attached to a respective electrical supply lead, a second electrical contact stud associated with each of said first contact studs and being attached to one of said arms, said socket further comprising means for abruptly biasing respective second contact studs into abutment with respective first contact studs upon axial insertion and rotation of said plug with respect to said socket, said plug and socket capable of occupying first and second positions, a first, open-circuit position in which said plug is not inserted within said socket, and said first and second contact studs are not in engagement, said first contact studs being located at an angular position different from the angular position occupied by said second contact studs, thus disconnecting said sockets from said electrical supply, and a second, distinct, position in which said plug is rotated with respect to said socket so that said respective first and second contact studs are abruptly biased into the same angular position with respect to said socket by a spring which engages each arm.

* * * * *